US005871187A

United States Patent [19]

Pihlaja et al.

[11] Patent Number: 5,871,187

[45] Date of Patent: Feb. 16, 1999

[54] FASTENING DEVICE

[75] Inventors: Harri Pihlaja; Veijo Makkonen, both of Kerava, Finland

[73] Assignee: Man-Metalli Oy, Kerava, Finland

[21] Appl. No.: 817,939

[22] PCT Filed: Oct. 27, 1995

[86] PCT No.: PCT/FI95/00595

§ 371 Date: Apr. 28, 1997

§ 102(e) Date: Apr. 28, 1997

[87] PCT Pub. No.: WO96/13184

PCT Pub. Date: May 9, 1996

[30] Foreign Application Priority Data

Oct. 28, 1994 [FI] Finland ..... 945093

[51] Int. Cl.[6] ..... F21V 21/00

[52] U.S. Cl. ..... 248/220.42; 248/214

[58] Field of Search ..... 248/220.42, 214, 248/226.11, 228.1, 231.71, 228.6, 235

[56] References Cited

U.S. PATENT DOCUMENTS

| | | | |
|---|---|---|---|
| 813,501 | 2/1906 | Keil . | |
| 2,883,137 | 4/1959 | Weber . | |
| 3,854,588 | 12/1974 | Kinard . | |
| 5,104,080 | 4/1992 | Berger . | |
| 5,282,368 | 2/1994 | Ordoukhanian | 248/214 |
| 5,372,348 | 12/1994 | Cheng | 248/231.71 |
| 5,456,046 | 10/1995 | Vitalune et al. | 248/214 |
| 5,472,164 | 12/1995 | Contee, Jr. | 248/214 |
| 5,588,166 | 12/1996 | Burnett | 248/214 |

FOREIGN PATENT DOCUMENTS

| | | |
|---|---|---|
| 0363868 | 4/1988 | European Pat. Off. . |
| 0564892 | 3/1993 | European Pat. Off. . |
| 2034085 | 2/1972 | France . |
| 8011539 | 11/1981 | France . |
| 1299250 | 6/1992 | France . |
| 2640423 | 3/1977 | Germany . |
| 3832537 | 3/1990 | Germany . |
| 83485 | 2/1954 | Norway . |
| 372165 | 12/1974 | Sweden . |
| 2045061 | 10/1980 | United Kingdom . |
| 2110076 | 6/1983 | United Kingdom . |
| 2285387 | 7/1995 | United Kingdom . |

*Primary Examiner*—Ramon O. Ramirez
*Assistant Examiner*—Willie Berry, Jr.
*Attorney, Agent, or Firm*—Browdy and Neimark

[57] ABSTRACT

The present invention relates to a fastening device (10) used in various shelves. The fastening device comprises a bracket extending through an opening (15) provided in the wall of the shelf frame (11). One surface of the bracket is placed against the inner surface (9) of the frame. The fastening device is provided with control means (18) which are arranged to draw the bracket towards the surface (9) of the frame and/or to adjust the position of a beam connected to the fastening device.

7 Claims, 2 Drawing Sheets

FIG. 5
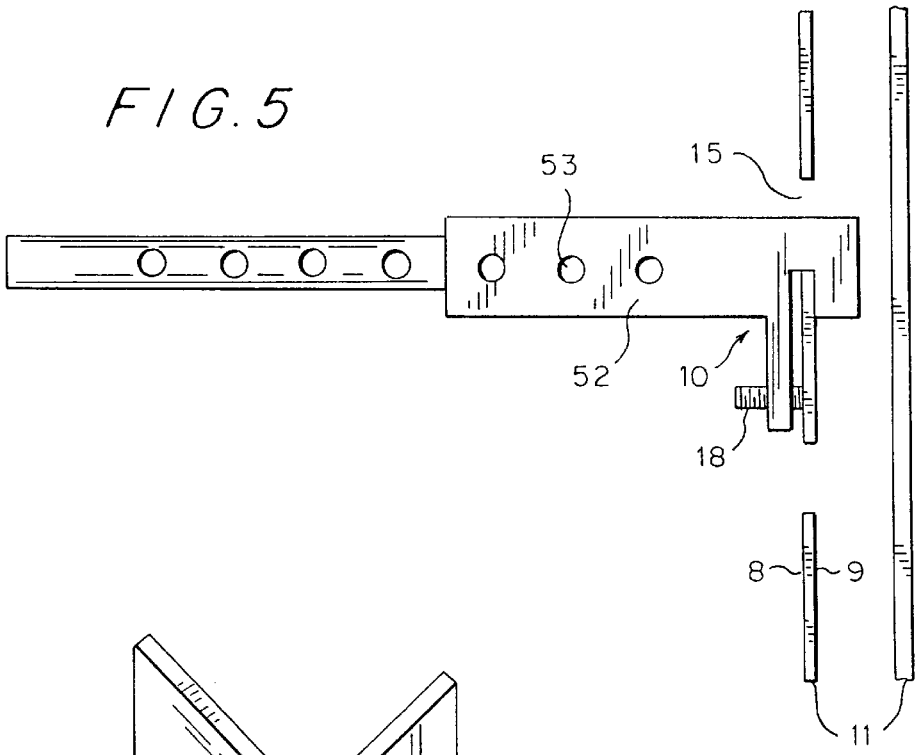
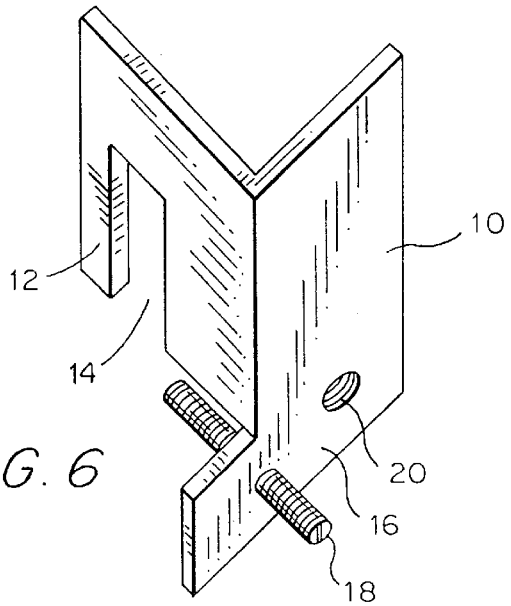
FIG. 6
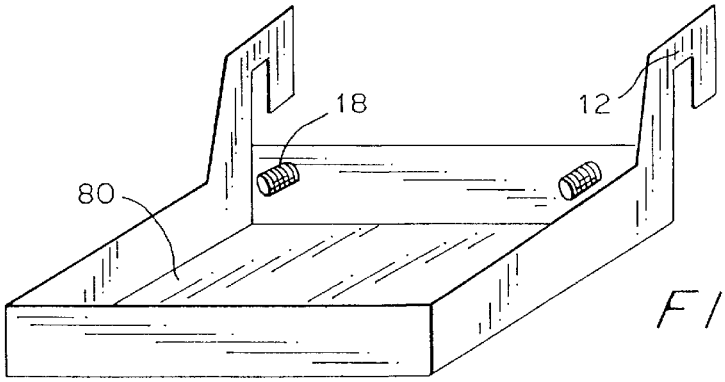
FIG. 7

FASTENING DEVICE

BACKGROUND OF THE INVENTION

1. Technical Field of the Invention

The present invention relates to a fastening device according to the preamble of claim 1 to be utilized in connection with various shelves and racks, stands, article holders and similar means for instance in shops, storages, transporting means and similar.

2. Prior Art

It is prior known to use a structure in the shelves, carriers or similar in which the shelf comprises frame means and therein fixed article supporting means, such as supporting arms, shafts or beams or shelf plates, extending horizontally or in certain angle from the frame means. The frame means form essentially straight body portions i.e. so called vertical pillars, which normally extend upwardly from the floor. Frame means are provided with a plurality of openings, and the supporting arms are normally clamped to the body portion by a hook-like portion or bracket provided in one end of the supporting arm and adapted to be positioned into the opening or openings of the body portion such that the arm is retained and supported by the bracket in the frame and retains the desired position relative to the frame. A slot or loop is normally defined between the bracket means and the arm such that said slot is adapted to receive the thickness of the frame means material. The width of said slot corresponds essentially accurately to the thickness of the material used in the frame, being only slightly wider than it, whereby the brackets are rigidly and accurately clamped to the body portion. Due to the simplicity and rapid assembly of said structure it is very commonly used, and the manufacturers of the shelves do each have a version of their own thereof, in which the shape and thickness of the brackets, the thickness of the frame material and the shape and size of the openings are different.

A disadvantage of the presented solutions has been that the hook-like bracket means of various manufacturers have followed "the standard" of each manufacturer, and thus are not suitable to be used in connection with other shelves. Therefore the users of the shelves have usually been forced to bind themselves to one supplier of the shelves, which may have had a disadvantageous effect to the costs. Furthermore, the clamping means i.e. hooks or brackets meant for one "shelf strength" fit only with one material thickness of the frame means. Thus several hooks designed to different material thicknesses are required, which has caused confusion among the users and even dangerous situations when a shelf has been assembled by using inappropriate hooks. Furthermore, sometimes the shelves may require an adjustment, for instance due to irregularities on the floor and/or slight deflections or inaccuracies in the manufacture of the arms. A prior art hook provided with a slot has not provided any possibility to adjust the position of the arm means, and thus the position has always been determined according to the fact how the slot of the hook and the frame portion fit to each other.

Norwegian patent No. 83485 discloses one improved fastening arrangement. According to that it is possible to adjust the position of the shelf beam by a therein integrated screw means. However, it is still a problem that the means and the shelf frame have to be manufactured to exactly correspond to each other, and they do not suit to be used in connection with other corresponding means. In addition, it is not possible to use the adjustment arrangement described therein in connection with a hook provided with a slot and most commonly used.

OBJECT OF THE INVENTION

An object of the present invention is to overcome the disadvantages of the prior art and to provide a totally new solution for the fastening of the supporting beams extending from the frame means by a fastening element of one single type to shelf frames of various types, the device according to said solution being simple in construction and reliable in operation, and the method according to said solution being easy to realize.

It is also an object of the present invention to provide a solution for the fastening in which it is possible to use a fastening device of one type in connection with shelf frame portions of different designs and/or of different material thicknesses for a controlled fastening of the beams. A further object of the invention is to provide a shelf assembly which can be assembled in a controllable manner.

SUMMARY OF THE INVENTION

The present invention is based on the idea that by adapting the slit or the slot or similar portion of the hook-like bracket means adapted to receive the material thickness of the frame portion of the shelf and extending from the fastening element to be essentially wider than the thickness of the material of the frame is and by providing the hook-like bracket means with a suitable adjusting means adapted to bear against said frame, an universal fastening device is provided.

According to a preferred embodiment of the present invention the device comprises a hook means adapted to be penetrable into the frame portion, a slot or similar portion thereof being essentially wider than the thickness of the material sheet used in the frame. A suitable backing means disposed outside the frame portion, such as a plate portion provided with a threaded hole and a screw means positioned therein, is arranged in connection with the hook means, preferably below said hook means. The screw means is arranged to bear against the frame means and thus to provide the clamping of the hook means against the frame. In other words, by screw means it is possible to remove "the gap" of the slot or similar being essentially greater than the material thickness of the frame, and thus to provide a tight clamping and if required, the adjustment of the position of the beam means. The screw means can, of course, be replaced by e.g. a suitable wedge means or cam means, by suitable washer plates or similar.

According to one additional and preferred embodiment the adjustable fastening devices according to the present invention form the shelf unit. In this case the fastening devices further comprise adjustable arm extending therefrom, the ends of the arms being provided with a suitable sheet-like element arranged to protect the goods stored on the shelf, such as a wire mesh or plexiglass. The fixing of said sheet-like element in the ends of the arm means is arranged such that it is easy to remove from the front of the shelves and, correspondingly, easy to place back and to lock in its position therein.

Remarkable advantages are obtained by the invention. A supporting beam means provided with a fastening device of one type can be used in connection with several different frame means, In addition, the placing of the supporting beam means into the openings of the frame means is made easier, and thus the work is less time consuming, since the slots of the hook means are not as tight as they have had to be in connection with the prior art shelves, e.g. due to safety reasons. The beam means can also be adjusted exactly to a desired position thereof.

In the following the present invention and the other objects and advantages thereof will be described by way of an example with reference to the annexed drawings, in which similar reference characters throughout the various figures refer to similar features. It should be understood that the following description of an example of the invention is not meant to restrict the invention to the specific forms presented in this connection but rather the present invention is meant to cover all modifications, similarities and alternatives which are included in the spirit and scope of the present invention, as defined by the appended claims. It is further noted that all such structures used in shelves which are designed to support goods or articles placed on them are meant by the terms beam or arm means or similar. Correspondingly, the term shelf is intended to include all such devices or means which are arranged for the storage or keeping, displaying, transportation, sorting or similar of the goods.

BRIEF DESCRIPTION OF THE DRAWINGS

FIG. 5 discloses one supporting member according to the present invention assembled into a shelf frame.

FIG. 6 discloses an alternative embodiment of the present invention.

FIG. 7 discloses a further alternative embodiment of the present invention.

DETAILED DESCRIPTION OF THE PREFERRED EMBODIMENT (S) OF THE INVENTION

Figure 1:
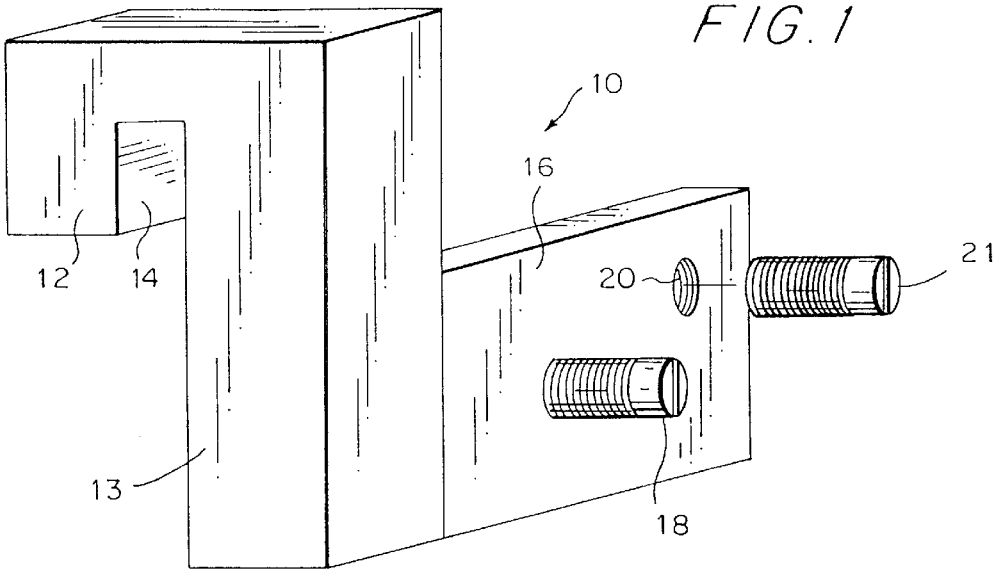
FIG. 1 is a perspective view of a fastening device according to the present invention.

FIG. 1 discloses a fastening device 10 according to the present invention. Said device 10 comprises a base portion 13, in which it is possible to fix a supporting element of a desired type, such as a shelf beam or arm (see e.g. FIGS. 2, 4 or 5), by a suitable manner known by the skilled person, such as by welding or by a screw assembly. A hook-like portion 12 extends from the upper portion of said base portion 1 3, said hook-like portion being adapted to be assembled or penetrated into an opening provided in the shelf frame such that the fastening device becomes clamped into the frame means at a desired height. The hook-like bracket 12 and the base portion 13 define a slot or loop 14 therebetween, which is adapted to receive the thickness of the wall material of the frame means. According to the present invention the slot 14 is essentially wider than is the thickness of the frame material.

The fastening device 10 according to the present invention further comprises an adjusting means portion, which in the example is formed of a plate 16 and therein suitably assembled adjusting screw 18. The other end of the adjusting screw is arranged to engage against the frame means of the shelf or a portion extending from the frame means and thus to draw the hook portion 12 towards one surface of the frame means (see FIGS. 4 and 5). The plate 16 can be further provided with means for the locking of the position of the fastening device 10, such as the disclosed threaded hole 20 in which a suitable screw means 21 extending through the shelf frame can be screwed. Said locking can be arranged by various other manners, such as by welding. In some cases there is no need for the locking.

Figure 2:
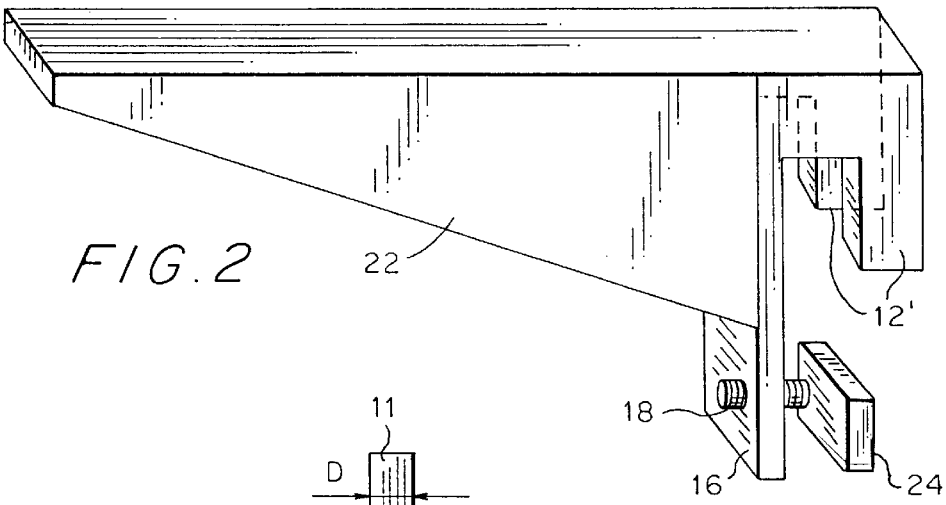
FIG. 2 is a perspective view of another embodiment of a fastening device according to the present invention.

FIG. 2 discloses a certain embodiment of the fastening device according to the invention, in which a supporting arm 22 is suitably combined therein. Hook means are also shown, which comprise two hook-like portions 12' adapted to fit into the respective openings in the shelf frame. In addition, a plate portion 16 and adjustment screw 18 corresponding to FIG. 1 are shown, as well as a special bearing plate means 24 provided in the end of the adjustment screw extending against the shelf frame. Such a bearing plate means is especially preferred in cases where the load supported by the beam 22 is essentially big or when it receives a shock-type loading, wherein said bearing plate means distributes the load to an essentially greater surface area than the sole end of the screw would distribute. In some cases it is preferred to provide the bearing plate means to extend essentially as widely as the plate portion 16 , whereby a structure is achieved which essentially tightly clamps the beam means 22 to the frame. The bearing plate means 24 also facilitates the tightening and/or loosening of the screw means.

Figure 3:
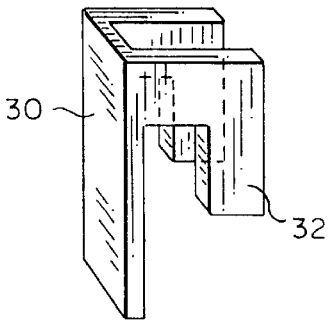
FIG. 3 is a perspective view of an additional embodiment of the fastening device of the present invention.

FIG. 3. discloses one adjusting means 30, which in this example is adapted to be utilized in the arrangement according to FIG. 2. The adjusting means 30 is formed of a sheet having a suitable material thickness, such as of 1–5 mm metal plate. The adjusting means 30 is adapted to be placed into the opening in the frame means of the shelf such that it will be disposed below the plate portion 16 according to FIG. 2, and thus provides a desired adjustment. It is possible to use several material thicknesses in the manufacture of the adjusting means 30 and thus to provide an adjustment member system by which various shelf portions can be versatilely arranged to a desired position.

Figure 4:
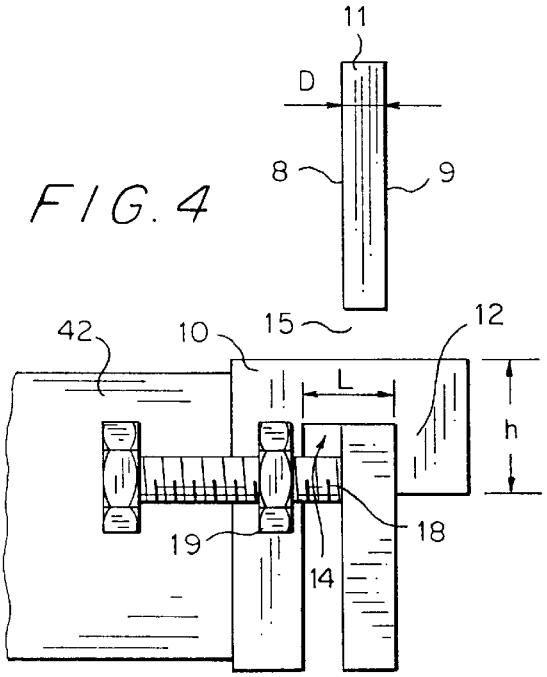
FIG. 4 discloses the principle of the present invention.

FIG. 4 illustrates the dimensions of the width of material thickness D of the opening 15 and the receiving slot 14. It has been essential in the prior art solutions that the dimension L has been adapted essentially accurately according to the thickness D of the frame. However, it can be noted that the dimension L is not longer required to be adapted accurately to correspond to dimension D. Thus, L can rather be essentially wider than the thickness D is.

By adapting the height h of the hook 12 suitably such that it is suits as many various types of frames and sizes of the openings as possible, a fastening device is provided which can very flexibly be suited to all kinds of frame solutions.

FIG. 4 also discloses a further possibility for the fixing of the tightening means relative to the fastening device 10. In the example a nut 19, through which the adjustment screw 18 extends, is assembled by means of welding on the side of the fastening device.

FIG. 5 discloses a beam means 52 arranged to be adjusted from the length thereof and to be settled by mounting holes 53, said beam means being clamped to the frame 11 by fastening device 10 according to the present invention.

FIG. 6 discloses one preferred arrangement in which the tightening means 18 is provided in the same vertical line with hook means 12 by a suitable design of the fastening device.

In the embodiment shown in FIG. 7 the fastening devices are arranged in two corners of an one-piece shelf box 80. In the example the adjusting means i.e. the screws 18 are positioned in the inner corners of the box, but it is, of course, possible to position them outside the box.

According to a method according to the present invention the assembly of a shelf is initiated by mounting a hook means, such as 12, into an opening 15 provided in the shelf frame 11 and adapted to receive the hook means. The fastening device is subsequently tightened fixedly to, and in some instances adjusted to a desired position, relative to the frame by a suitable adjusting means, such as 18 or 30. According to one embodiment it is also preferred to lock the fastening device into the final position thereof. According to one further preferred embodiment arms having a suitable structure for the adjustment of the length thereof are fixed to the fastening devices.

Thus the invention provides an arrangement and a method by means of which a significant advantage is obtained during the assembly, disassembly and modifying of the shelves. The assembly and modifying is facilitated since the number of different parts is decreased. By means of the invention, the position and the properties of the shelves, such as the sloping and the size of the shelves, can be arranged to be precisely in a desired manner. The disassembly is facilitated since the joints may be opened to be sufficiently "loose" to facilitate the disassembly. In addition, the level of safety of the shelves is improved since it is not possible to use improper/unsuitable parts in the assembly stage of the shelves due to the suitability of one single fastening device to the most shelf designs.

It should be noted that the above disclosed examples of the embodiments of the invention do not restrict the scope of protection defined by the claims. With the help of the above description and the drawings it is obvious to the skilled person to use the method and device according to the invention in connection with, for instance, shelves having a frame structure formed of an essentially solid sheet, in which one or several openings receiving the fastening devices are provided.

We claim:

1. A fastening device for the fastening of the of a shelf beam (22; 42; 52; 80) to an opening in a shelf frame (11), said fastening device (10) comprising hook-like bracket means (12;12,12') forming a slot (14) adapted to be assembled into the opening (15) provided in the shelf frame (11) for receiving the fastening device such that a portion of the shelf frame wall will be placed into said slot, wherein said hook-like bracket means (12;12,12') is provided on an upper edge of the fastening device and form means for extending into the openings (15) of the shelf frame (11), the fastening device (10) further comprising a clamping screw (18) in a side of the shelf beam extending through a threaded member (19) provided in connection with the fastening device towards said slot (14) one end of the screw being adapted to bear against a surface (8) of the shelf frame (11) from the side of the shelf beam, the arrangement being such that said screw is adapted to provided a clamping force between said hook-like bracket means (12;12,12') at the upper edge of the fastening device and the shelf frame and to control the width of the slot (14) of the bracket means, whereby it is possible to provide a clamped fastening of an essentially similar universal fastening device (10) to various type of shelf frames and opening of the shelf frames.

2. A fastening device according to claim 1, it further comprises a bearing plate means (24) arranged between the clamping screw (18) and the frame (11) such that it is adapted to bear against the frame (11) as the clamping screw is tightened to distribute the clamping force onto a wider area on the frame surface.

3. A fastening device according to claim 1, further comprising an intermediate plate means (30) adapted to be assembled between the fastening device (10) and the shelf frame (11), said intermediate plate means being provided with brackets (32) arranged to fit into the openings (15) of the frame (11).

4. A fastening device according to claim 1, further comprising locking means (20) of the clamping screw (18) for retaining the position of the clamping screw after it has been tightened to provide said clamped fastening of the fastening device.

5. A fastening device according to claim 1, further comprising a beam means (52) extending from the fastening device (10) and being adapted to be adjustable from a length thereof.

6. A fastening device according to claim 1, wherein the clamping means (18) are arranged into essentially the same vertical line as the bracket means (12).

7. A shelf assembly, comprising a shelf frame, a shelf beam or similar supporting element, a fastening device for fastening the shelf beam or similar supporting element to the shelf frame, an opening provided in the shelf for receiving the fastening device, wherein said fastening device comprises hook-like bracket means forming a slot adapted to be assembled into the opening in the frame such that a portion of the shelf frame wall will be placed into said slot, the assembly being such that said hook-like bracket means are provided only in the upper edge of the fastening device and form the sole means extending into the opening of the shelf frame, the fastening device further comprising a clamping screw in the side of the shelf beam or similar supporting element and extending through a threaded member provided in connection with the fastening device towards said slot or an extension thereof, the other end of the screw being adapted to bear against a surface of the shelf frame from the side of the shelf beam or similar supporting element, said screw being adapted to provide a clamping force between said sole hook-like bracket means at an upper edge of the fastening device and the shelf frame and to control the width of the slot of the bracket means, whereby it is possible to provide a clamped fastening of an essentially similar universal fastening device to various types of shelf frames and openings of the shelf frames.

* * * * *